US007396273B2

(12) United States Patent
Styles-Gaviria et al.

(10) Patent No.: US 7,396,273 B2
(45) Date of Patent: Jul. 8, 2008

(54) DECORATIVE STRAPS FOR A BRA AND A BRA INCORPORATING THE SAME

(76) Inventors: Shelli L. Styles-Gaviria, 2290 N. Hametown Rd., Akron, OH (US) 44333-1028; Octavio Gaviria, 2290 N. Hametown Rd., Akron, OH (US) 44333-1028

( * ) Notice: Subject to any disclaimer, the term of this patent is extended or adjusted under 35 U.S.C. 154(b) by 46 days.

(21) Appl. No.: 11/588,029

(22) Filed: Oct. 26, 2006

(65) Prior Publication Data

US 2007/0105482 A1 May 10, 2007

Related U.S. Application Data

(60) Provisional application No. 60/733,743, filed on Nov. 4, 2005.

(51) Int. Cl.
*A41C 3/00* (2006.01)
*A41C 3/12* (2006.01)

(52) U.S. Cl. ..... 450/86; 2/336; 2/338; 450/1

(58) Field of Classification Search ..... 450/86, 450/88, 1; 2/106, 73, 67, 336, 311, 312, 2/105, 78.1–78.4; D2/700, 701, 703, 706, D2/708, 731, 734, 793
See application file for complete search history.

(56) References Cited

U.S. PATENT DOCUMENTS

| | | | | | |
|---|---|---|---|---|---|
| D278,473 | S * | 4/1985 | Briggery Myles | ..... | D2/731 |
| 6,086,451 | A * | 7/2000 | Fernandes | ..... | 450/86 |
| 6,155,906 | A * | 12/2000 | May | ..... | 450/88 |
| 6,186,861 | B1 * | 2/2001 | Flaherty | ..... | 450/1 |
| 6,517,409 | B2 * | 2/2003 | Flaherty | ..... | 450/1 |
| 6,938,440 | B2 * | 9/2005 | Smith | ..... | 63/1.18 |

OTHER PUBLICATIONS

Africa My Bra beaded bra straps at www.africamybra.com ; Oct. 11, 2004; 2 pages—showing beaded strung bra straps with bead configuration as applicant's.*

Beaded Bra Straps=Chic Black—www.brastrapsaustrailia.co.au; Jul. 9, 2005—showing bra strap with beads, bra strap adjsuter and slide buckle fasteners at ends.*

* cited by examiner

*Primary Examiner*—Gloria Hale
(74) *Attorney, Agent, or Firm*—Howard M. Cohn

(57) ABSTRACT

A bra incorporating bra straps that are made from beads threaded onto an elongated tubular member in a decorative pattern. The straps include end connectors that allow them to be detachably secured to the bra. The straps may also include an adjustment member to allow the length of the straps to be lengthened or shortened.

11 Claims, 6 Drawing Sheets

DECORATIVE STRAPS FOR A BRA AND A BRA INCORPORATING THE SAME

CROSS-REFERENCE TO RELATED APPLICATIONS

This application claims priority from U.S. Provisional Application No. 60/733,743, filed Nov. 4, 2005, the entire specification of which is incorporated herein by reference.

BACKGROUND OF THE INVENTION

1. Technical Field

This invention generally relates to clothing. More particularly, the invention relates to a tops and bras. Specifically, the invention relates to decorative beaded bra straps and to a bra which incorporates the same.

2. Background Information

It has recently become fashionable for younger women to wear dresses and shirts that allow their bra straps to be seen. As a result, the lingerie industry has started producing bras that are made in bright attractive colors. While these straps are slightly more attractive than the traditional white, black or flesh colored bras, they do not necessarily enhance the dress or shirt that they are worn under. There is, therefore, still room in the industry for bras that have decorative straps and for decorative straps that can be used to replace conventional bra straps.

SUMMARY OF THE INVENTION

The present invention is a bra strap that is made from a plurality of beads which are strung together in a decorative manner in any one of a variety of patterns. The strung beads are fixed to end connectors that are customarily used on bra straps. Furthermore, the bra straps are made in a manner that allows them to be adjusted in the same manner as conventional bra straps already known in the art. The invention further comprises a bra incorporating such decorative beaded bra straps.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
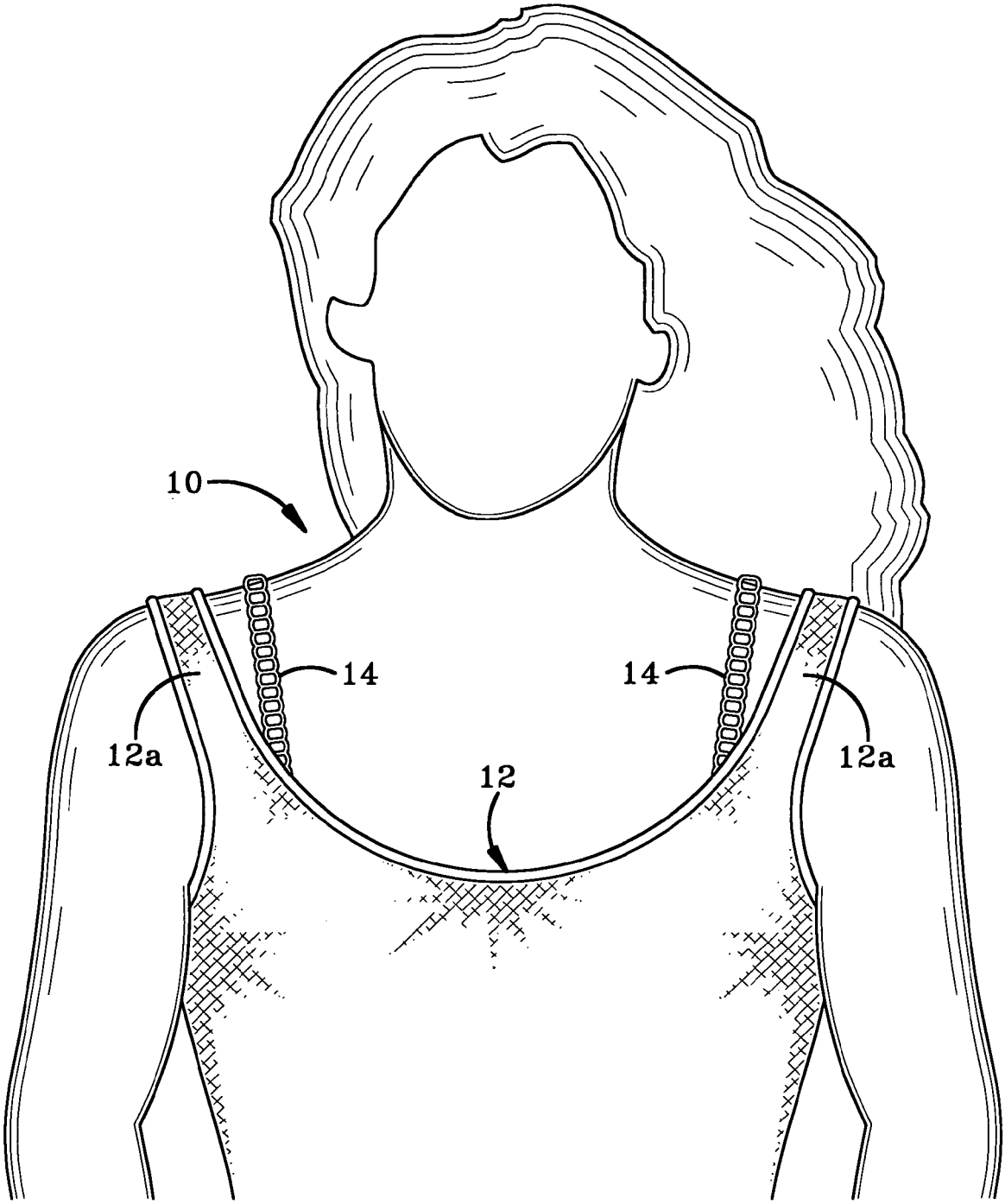
FIG. 1 is front view showing a person wearing a shirt and illustrating the bra straps in accordance with the present invention being visible.
Figure 2:
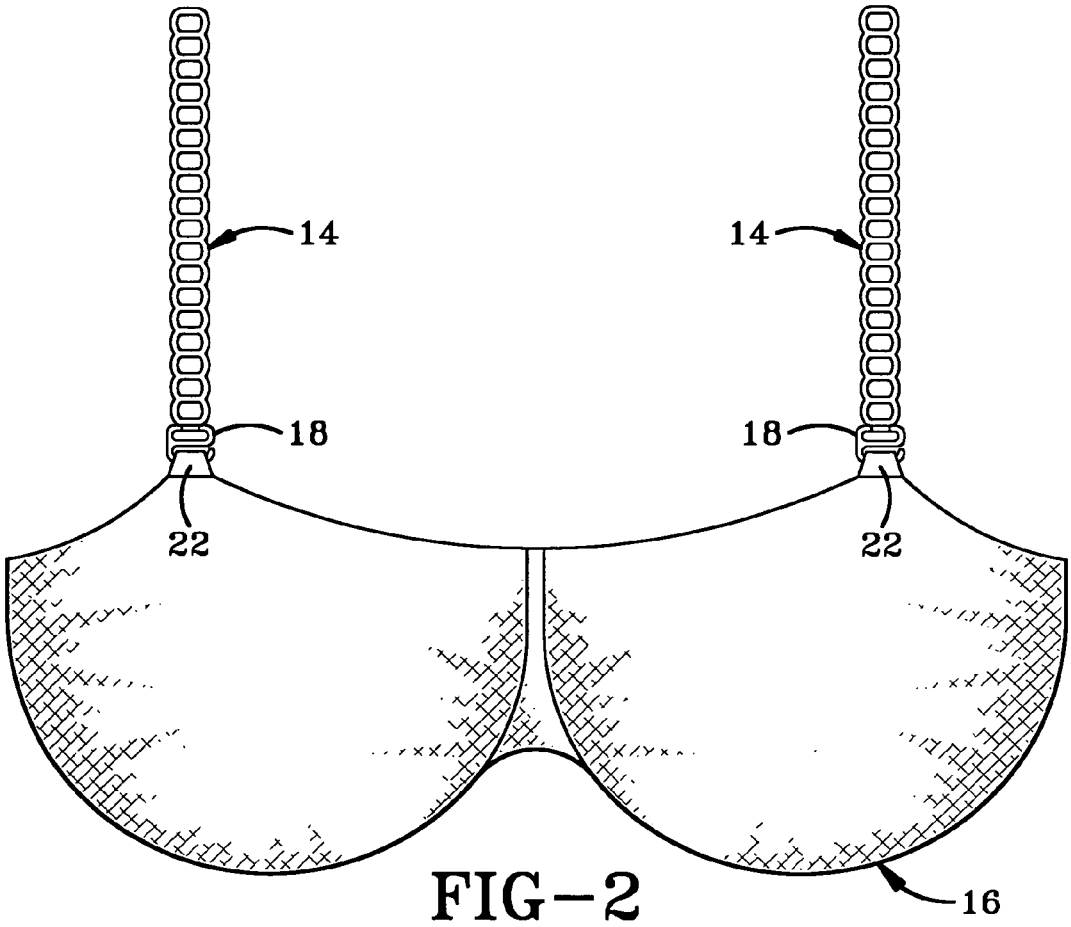
FIG. 2 is a front view of a bra in accordance with the present invention and showing the decorative bra straps attached thereto.
Figure 3:
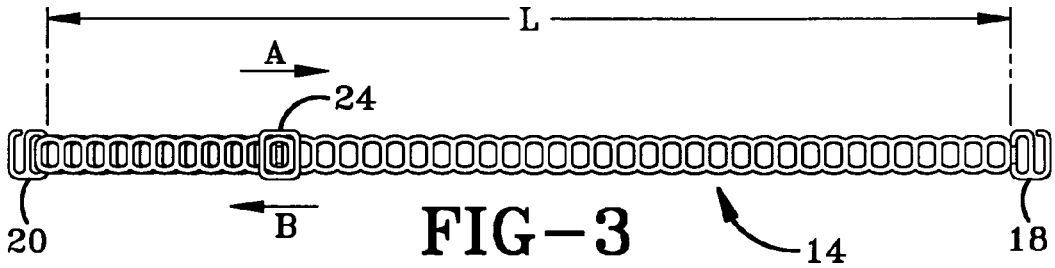
FIG. 3 is a top view of a bra strap in accordance with the present invention.
Figure 4:
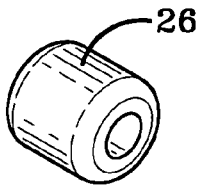
FIG. 4 is a perspective view of a bead used in the manufacture of the bra straps.
Figure 5:
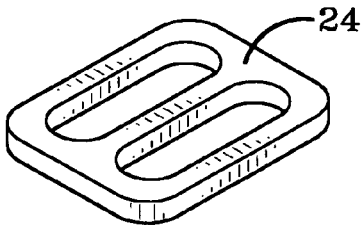
FIG. 5 is a perspective view of the adjustment member utilized in the bra straps.
Figure 6:
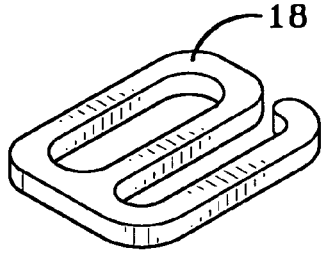
FIG. 6 is a perspective view of the end connector utilized in the bra straps.

Referring to FIG. 1-6, there is shown a woman 10 wearing a shirt or top 12. The shirt 12 has narrow shoulder straps 12*a* and, consequently, the straps 14 of her bra (not seen) are visible.

Referring to FIGS. 2-6, there is shown a bra 16 in accordance with the present invention and illustrating thereon the decorative bra straps 14 in accordance with the present invention. Straps 14 are secured to bra 16 by way of first and second end connectors 18, 20. First and second end connectors 18, 20 are substantially identical to each other. Each first end connector 18 is secured through a looped portion 22 (FIG. 2) on the front of bra 16 and each second end connector 20 is secured to a similarly looped portion (not shown) on the back of bra 16. A first end of strap 14 is connected to first end connector 18 and a second end of strap 14 is connected to an adjustment member 24. Second end connector 20 is retained on said strap 14 and is slidable therealong. The adjustment member 24 is provided intermediate first and second end connectors 18, 20 and is slidable along strap 14. The length "L" of strap 14 is that distance between first and second end connectors 18 and 20. Sliding adjustment member 24 along strap 14 effectively changes the length "L" of strap 14. Movement of the adjustment member 24 in the direction of arrow "A" (FIG. 3) will reduce the length "L" of strap 14. Movement of adjustment member 24 in the direction of arrow "B" will increase the length "L" of strap 14. It will be understood that first and second end connectors 18, 20 and adjustment member 24 are well known in the art.

In accordance with a specific feature of the present invention, bra strap 14 is manufactured substantially entirely from a plurality of beads 26 which are threaded onto a suitable elongated tubular member 28. Beads 26 may be manufactured from a variety of different materials including, but not limited to glass, plastic, metal, shells and polished stones. Preferably, the material selected will be one that is smooth on the skin, won't snag on clothing and is durable, colorful and attractive. Beads 26 may also be of any desired size and shape. Furthermore, any combination and variation in sizes, shapes, colors and materials for beads 26 may be selected without departing from the spirit of the present invention.

Figure 7:
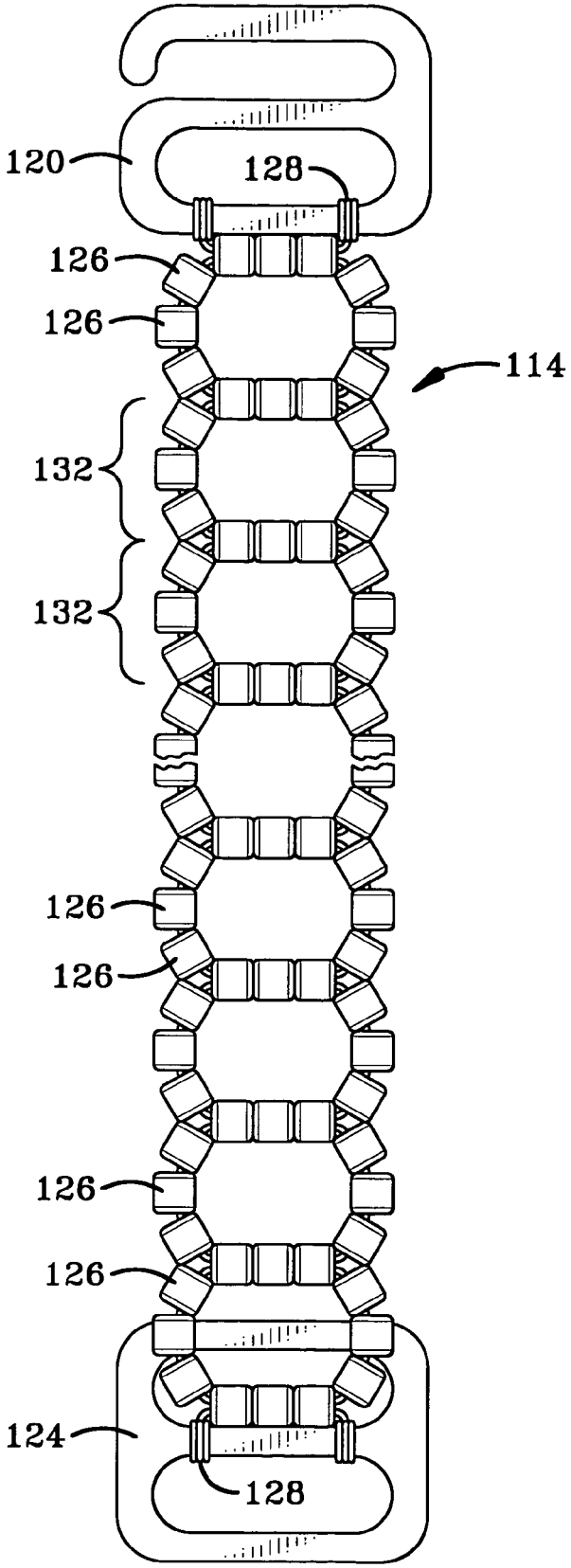
FIG. 7 is a top view of a section of bra strap in accordance with the present invention and showing a first decorative bead pattern formed therein.
Figure 8:
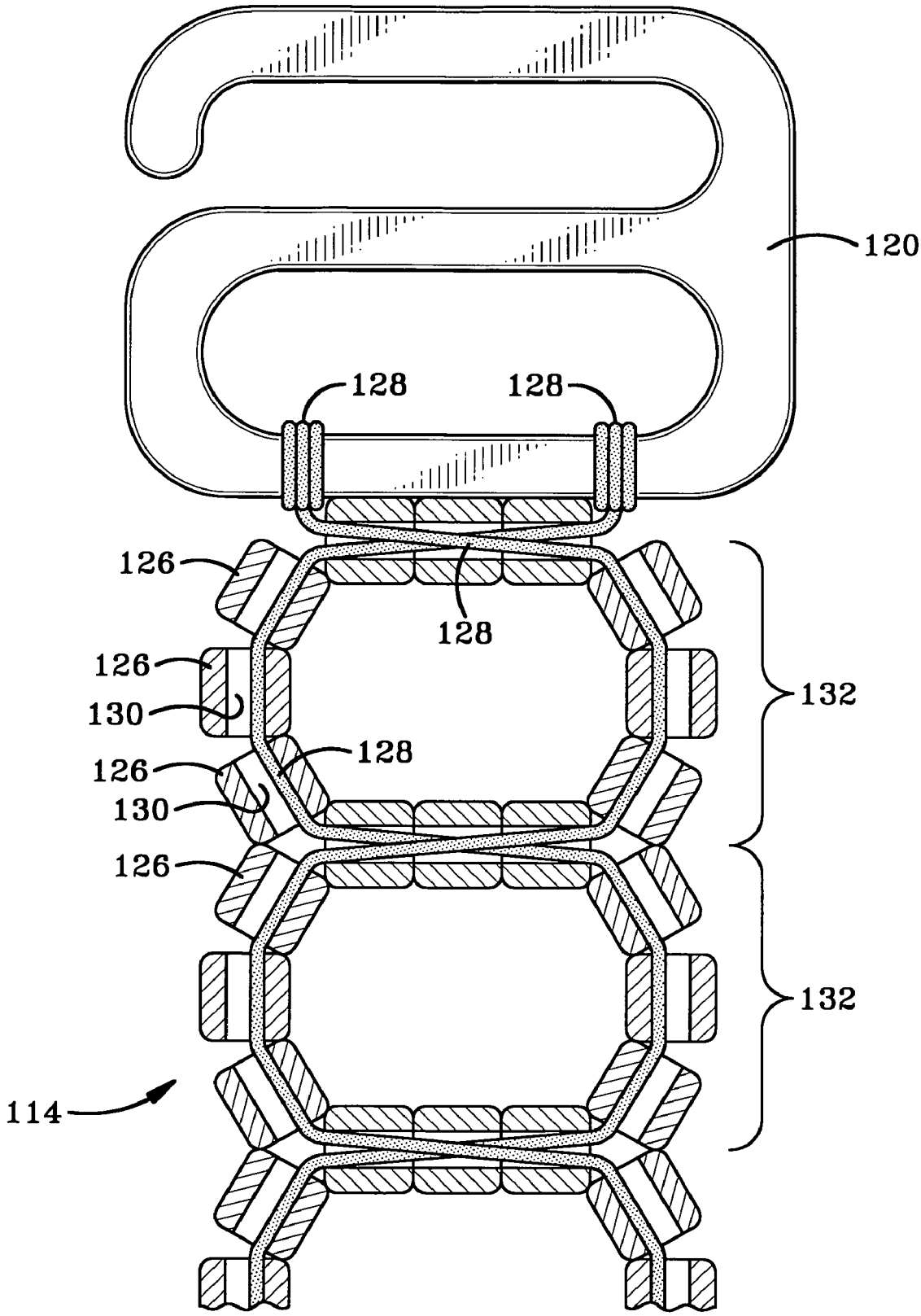
FIG. 8 is a partial cross-sectional top view of one end of the bra strap of FIG. 7 and showing the connection of the strap to the end connector.

FIGS. 7 & 8 shows an example of a first bead pattern for a bra strap 114 in accordance with the present invention. A plurality of first beads 126 are strung onto a suitable elongated tubular member 128. Tubular member 128 could be fishing line, beading wire, thread, yarn, elastic or any other suitable material that can be threaded through the bores 130 of beads 126. The beads 126 are threaded onto tubular member 128 in any suitable manner known to those of ordinary skill in the art. Tubular member 128 is wrapped around a portion of the second end connector 120. The free end (not shown) of tubular member 128 is threaded back through the bores 130 of one or more beads 126 so that it will not snag on clothing or allow beads 126 to slide off from tubular member 128. It will be understood by those skilled in the art that any known techniques and methods of securing and finishing off tubular member 128 is contemplated as falling within the scope of this invention.

In this first decorative bead pattern a plurality of substantially identically sized beads 126 are strung together to form a plurality of generally rectangular, connected shapes 132. An adjustment member 124 is secured to strap 114 spaced distance from the second end connector 120 and in substantially the same manner as is second end connector 120.

Figure 9:
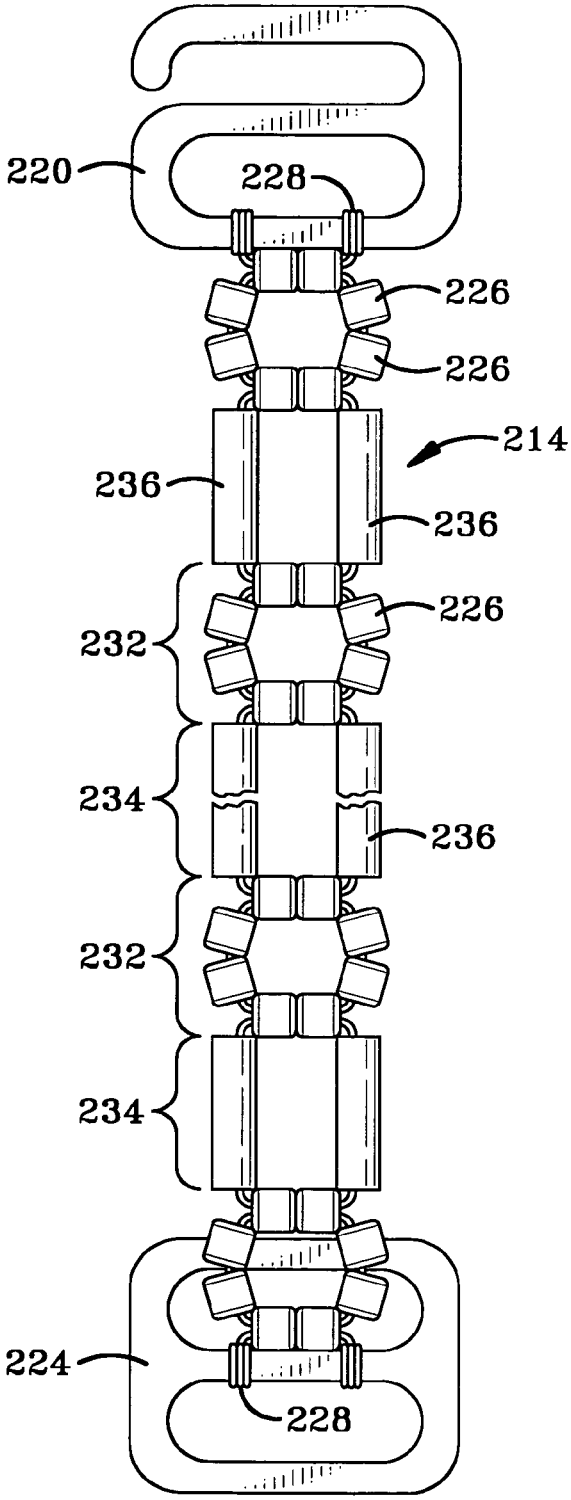
FIG. 9 is a top view of a section of bra strap in accordance with the present invention and showing a second decorative bead pattern formed therein.
Figure 10:
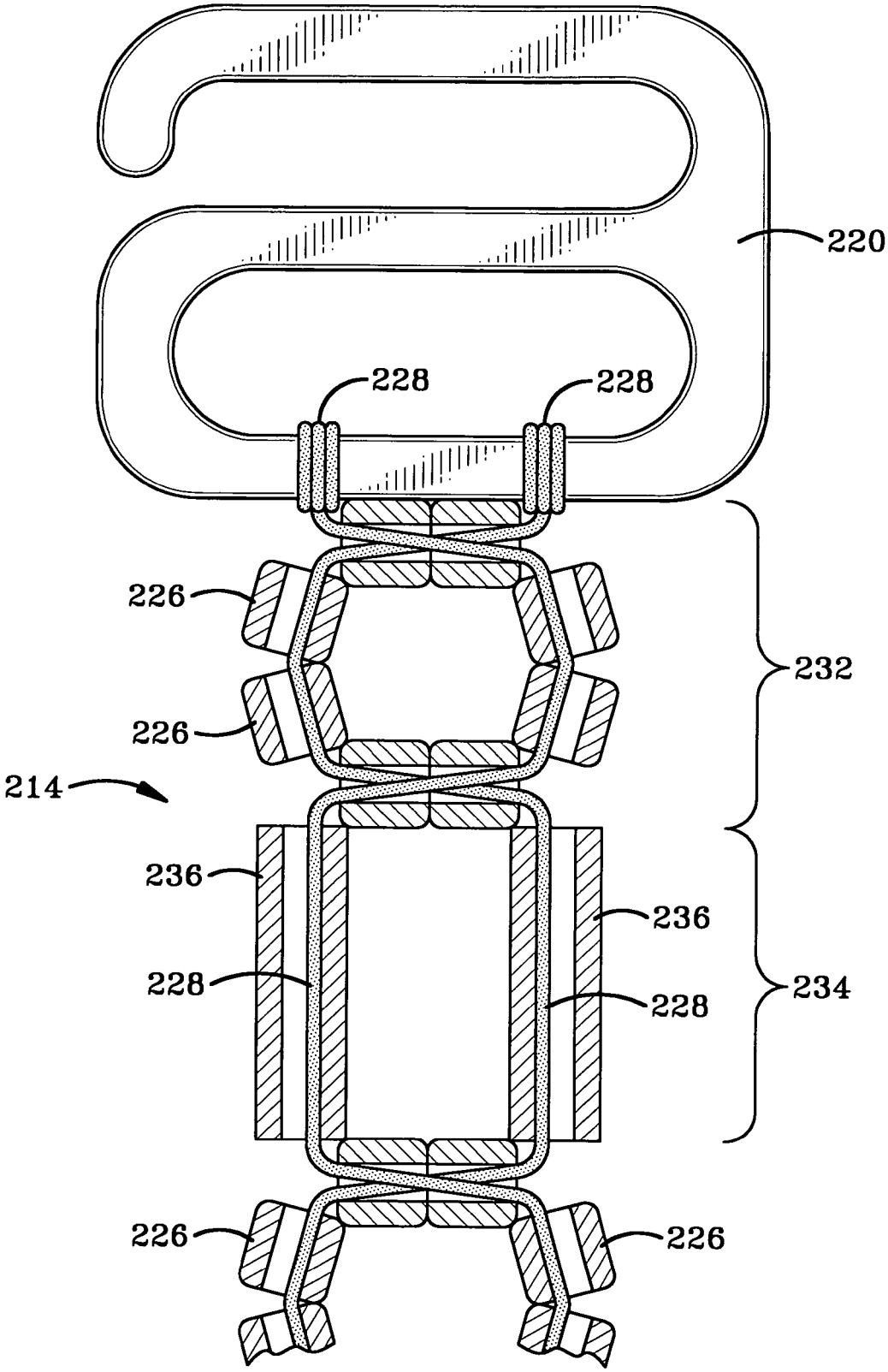
FIG. 10 is a partial cross-sectional top view of one end of the bra strap of FIG. 9 and showing the connection of the strap to the end connector.

FIGS. 9 & 10 show a second bead pattern for a bra strap 214 in accordance with the present invention. A plurality of second beads 226 and third beads 236 are strung on a tubular member 228 such as fishing line or wire. The beads 226, 236 are strung onto tubular member 228 to form different shaped patterns 232, 234 that are connected together in a sequence. Second beads 226 and third beads 236 are different in both size and shape from each other. The adjustment member 224 is secured to strap 214 a spaced distance from first end connector 220.

Figure 11:
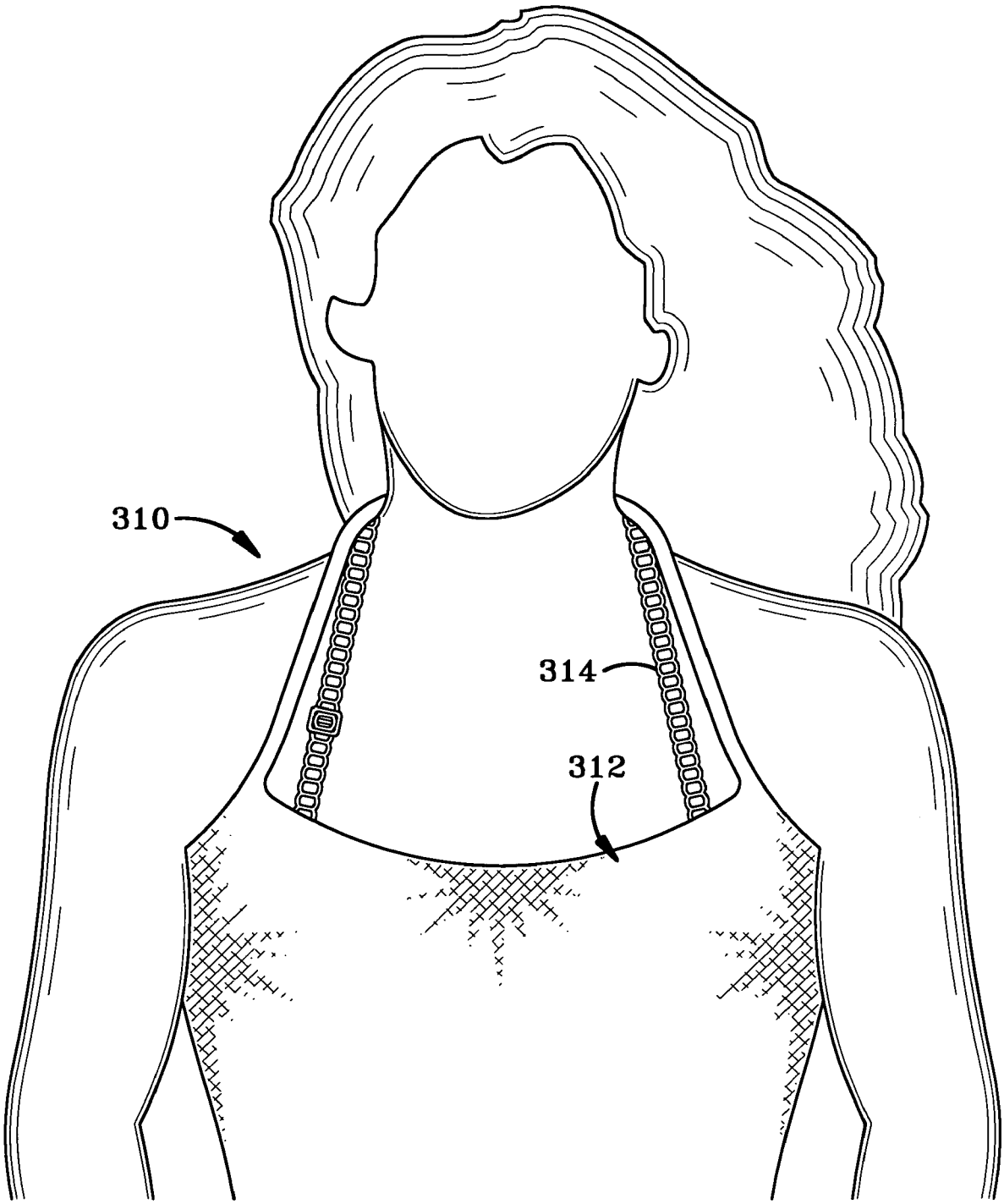
FIG. 11 is a front view of a woman wearing a halter top style bra with a decorative strap thereon.

FIG. 11 shows a woman 310 wearing a shirt 312 and having the straps 314 of her bra showing. It can be seen that, in this instance, the bra is of a halter style. It will be understood that any strapped bra design is contemplated as falling within the scope of the present invention.

It will be understood that any desired pattern and sequence of beads can be produced and incorporated into a bra strap without departing from the spirit of the present invention.

It will further be understood that the bra strap in accordance with the present invention is made substantially entirely from beads and an appropriate material for threading the same.

It will further be understood that the decorative bra straps made in accordance with the present invention may be used on a plurality of different bras and that differently configured decorative bra straps can be used in association with a single bra to provide a variety of different looks. It will further be understood that the bra in question may be an article of clothing or an article of swimwear.

It will further be understood that, if desired, more than one decorative bra strap could be connected to each of the looped portions 22 on a bra to provide a double-strapped look, without departing from the spirit of the present invention.

It will be understood by those skilled in the art that the strap can be manufactured from a plurality of beads strung in any one of a variety of decorative patterns, incorporating beads of various sizes, shapes and colors without departing from the spirit of the present invention.

It will further be understood that the decorative bra straps of the present invention could replace conventionally provided straps on underwear and clothing such as on camisoles and spaghetti-strapped T-shirts, and spaghetti-strapped dresses.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A decorative strap for an article of clothing, said strap comprising:

an elongated tubular member;

a plurality of beads strung on an said elongated tubular member to form a beaded portion substantially entirely of the plurality of beads;

a first end connector secured to a first end of the beaded portion and being adapted to secure the same to the article of clothing;

an adjustment member secured to a second end of the beaded portion; and wherein said adjustment member is secured to the beaded portion formed substantially entirely of the plurality of beads a spaced distance from a second end connector and a first distance from the first end connector and is also slidably engaged on the beaded portion and is movable in a first direction along the beaded portion to increase the length of the beaded portion, and is movable in a second direction along the beaded portion to decrease the length of the beaded portion; and the second end connector slidably engaged on the beaded portion and being adapted to secure the same to the article of clothing.

2. The decorative strap as defined in claim 1, wherein the plurality of beads are strung on the elongated tubular member in a decorative pattern.

3. The decorative strap as defined in claim 2, wherein the elongated tubular member is selected from the group consisting of fishing line, wire, thread, yarn and elastic.

4. The decorative strap as defined in claim 1, wherein the plurality of beads includes beads of any one of different sizes, colors, materials and shapes.

5. The decorative strap as defined in claim 1, wherein the article of clothing comprises any one of a bra, a spaghetti-strapped T-shirt, a camisole and a spaghetti-strapped dress.

6. A garment shoulder strap made from plurality of beads strung on an elongated tubular member, wherein said beads extend from a first end of the tubular member to a second end thereof to form a beaded tubular member and wherein said strap includes a first end connector at the first end of the tubular member and a second end connector at the second end of the tubular member being slidably movable along a length of the beaded tubular member; and an adjustment member which is fixedly connected to the second end of the beaded tubular member; said adjustment member being slidably engaged with the beaded tubular member intermediate the first and second end connectors whereby the length of the beaded tubular member can be increased by sliding the adjustment member along the beaded tubular member in a first direction and decreased by sliding the adjustment member along the beaded tubular member in a second direction.

7. The bra as defined in claim 6, wherein the plurality of beads are strung on the elongated tubular member in a decorative pattern thereby forming a beaded tubular member.

8. The bra as defined in claim 6, wherein the tubular member is selected from the group consisting of fishing line, wire, thread, yarn and elastic.

9. The bra as defined in claim 6, wherein the plurality of beads includes beads that are of any one of different sizes, materials, colors and shapes.

10. The bra as defined in claim 7, wherein the first end connector being is detachably secured to a looped portion on the bra.

11. The bra as defined in claim 10, wherein the second end connector is detachably secured to a second looped portion on the bra.

* * * * *